US007663579B2

(12) United States Patent
Jung et al.

(10) Patent No.: US 7,663,579 B2
(45) Date of Patent: Feb. 16, 2010

(54) ORGANIC ELECTROLUMINESCENCE DISPLAY DEVICE

(75) Inventors: Sang-Hoon Jung, Seoul (KR); Sung-Ki Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 385 days.

(21) Appl. No.: 11/647,175

(22) Filed: Dec. 29, 2006

(65) Prior Publication Data

US 2007/0152937 A1 Jul. 5, 2007

(30) Foreign Application Priority Data

Dec. 30, 2005 (KR) ..... 10-2006-0136138

(51) Int. Cl.
*G09G 3/30* (2006.01)

(52) U.S. Cl. ..... 345/76; 315/169.3

(58) Field of Classification Search ..... 345/76–81; 315/169.3

See application file for complete search history.

(56) References Cited

U.S. PATENT DOCUMENTS 6,800,999 B1 * 10/2004 Duggal et al. ..... 315/169.1
7,227,517 B2 * 6/2007 Imamura ..... 345/76
7,339,317 B2 * 3/2008 Yamazaki ..... 313/506

* cited by examiner

*Primary Examiner*—Alexander Eisen
*Assistant Examiner*—Jeffrey Steinberg
(74) *Attorney, Agent, or Firm*—Holland & Knight LLP

(57) ABSTRACT

An electroluminescence display device includes a first switching device for transferring a data current, which represents a data signal, using a first scan signal, a second switching device for transferring the data current from the first switching device using a second scan signal, a storage device for storing a charge voltage according to the data current transferred from the second switching device, a coupling unit for changing the charge voltage stored in the storage device in accordance with the first scan signal into a changed voltage, driving devices for generating a driving current in accordance with the changed voltage, and an organic light emitting diode for emitting light in accordance with the driving current.

7 Claims, 9 Drawing Sheets

ORGANIC ELECTROLUMINESCENCE DISPLAY DEVICE

This application claims the benefit of Korean Application No. 10-2005-0136138, filed on Dec. 30, 2005, which is hereby incorporated by reference in its entirety.

BACKGROUND OF THE INVENTION

1. Field of the Invention

Embodiments of the invention relate to a display device, and more particularly, to an organic electroluminescence display device. Although embodiments of the invention are suitable for a wide scope of applications, they are particularly suitable for supplying low current to an organic light emitting device (OLED) even in the case of a high data current being applied to the an organic light emitting device.

2. Description of the Related Art

Recently, organic electroluminescence display (OLED) devices have attracted considerable attention as a display device of the next generation due to its advantages of high contrast ratio, high luminance, low power consumption, fast response time, and wide viewing angle. Because of such advantages, the organic electroluminescence display device is widely used for mobile phones, personal digital assistants, computers, and televisions. Furthermore, the organic electroluminescence display device is a self-light emitting type, thereby displaying visible light including blue light. Accordingly, the OLED device can display colors close to natural colors. Moreover, since the organic electroluminescence display device has fast response time of several microseconds, the organic electroluminescence display device can easily display moving images. Further, the organic electroluminescence display device has no limitation on viewing angle and is stable at low temperatures. Furthermore, the organic electroluminescence display device can be fabricated through a simple thin film fabrication process since the organic electroluminescence display device is an ultra-thin film type display device.

The organic electroluminescence display device displays images by driving pixels of M×N organic electroluminescence display devices using a voltage or current. A driven pixel emits light by electrically exciting a fluorescent organic compound. However, the organic electroluminescence display device has problems in that luminance is irregular and driving control becomes difficult due to sensitivity differences among blue, green and red fluorescent organic compounds if a voltage driving mode is applied to the organic electroluminescence display device in the same manner as a liquid crystal display device. Accordingly, a current driving mode is typically used in the driving of organic electroluminescence display devices.

An active matrix type organic electroluminescence display device is widely used, wherein a plurality of pixels are arranged in a matrix arrangement and image information is selectively supplied to each pixel through a switching device, such as a thin film transistor provided in each pixel. However, in a current driving mode, which drives a plurality of organic light emitting diodes (OLED) of the organic electroluminescence display devices using a current, a parasitic capacitance exists between a data line supplying a data current to a data signal and a cathode of the OLED. In this case, the capacitance occurring in the data line should be charged quickly to drive the organic electroluminescence display device at a high speed. However, problems occur in that a high current is required to quickly charge the capacitance of the data line, and the OLED is damaged if the high current flows in the OLED. In other words, the related art current driving mode has a problem in that the OLED to which the high current is supplied should be driven at a low current but yet high speeds are desired.

SUMMARY OF THE INVENTION

Accordingly, embodiments of the invention are directed to an organic electroluminescence display device that substantially obviates one or more of the problems due to limitations and disadvantages of the related art.

An object of embodiments of the invention is to provide an organic electroluminescence display device that drives an OLED at a low current in a current driving mode even in the case in which a high data current is applied thereto.

Another object of embodiments of the invention is to provide an organic electroluminescence display device that uses a high data current to increase speed and a reduced driving current to increase the lifetime of an OLED.

Another object of embodiments of the invention is to provide an organic electroluminescence display device that can be driven at a low driving current through a high data current without decrease of aperture ratio.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described herein, there is provided an electroluminescence display device includes a first switching device for transferring a data current, which represents a data signal, using a first scan signal, a second switching device for transferring the data current from the first switching device using a second scan signal, a storage device for storing a charge voltage according to the data current transferred from the second switching device, a coupling unit for changing the charge voltage stored in the storage device in accordance with the first scan signal into a changed voltage, driving devices for generating a driving current in accordance with the changed voltage, and an organic light emitting diode for emitting light in accordance with the driving current.

In another aspect of the invention, there is provided an electroluminescence display device including a data driver for supplying a data current according to a data signal, a first switching device for transferring the data current using a first scan signal, a second switching device for transferring the data current from the first switching device using a second scan signal, a storage device for storing a charge voltage according to the data current transferred from the second switching device, a coupling unit for changing the charge voltage stored in the storage device in accordance with the first scan signal into a changed voltage, first and second driving devices driven simultaneously in accordance with the changed voltage, and an organic light emitting diode for emitting light in accordance with a driving current through the first and second driving devices.

In another aspect, a method of operating electroluminescence display includes applying a first scan signal to a first switching device for transferring a data current, applying a second scan signal to a second switching device for transferring the data current from the first switching, charging a storage device with a charge voltage according to the data current transferred from the second switching device, changing the charge voltage stored in the storage device with a coupling unit in accordance with the first scan signal into a changed voltage, applying the changed voltage simultaneously to the first and second driving devices, and driving an organic light emitting diode for emitting light in accordance with a driving current through the first and second driving devices.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings:

FIG. 6A to FIG. 6C illustrate simulation results of a basic pixel according to an embodiment of the invention having a storage device and a coupling unit, in which FIG. 6A is a graph illustrating the relation between a data current Id and a driving current $I_{EL}$ flowing in an organic light emitting diode, FIG. 6B is a graph illustrating a scaling factor of data and driving currents according to C2/C1, and FIG. 6C is a graph illustrating variation of a driving current $I_{EL}$ according to variation of a threshold voltage.

DETAILED DESCRIPTION OF THE PREFERRED EMBODIMENTS

Figure 1:
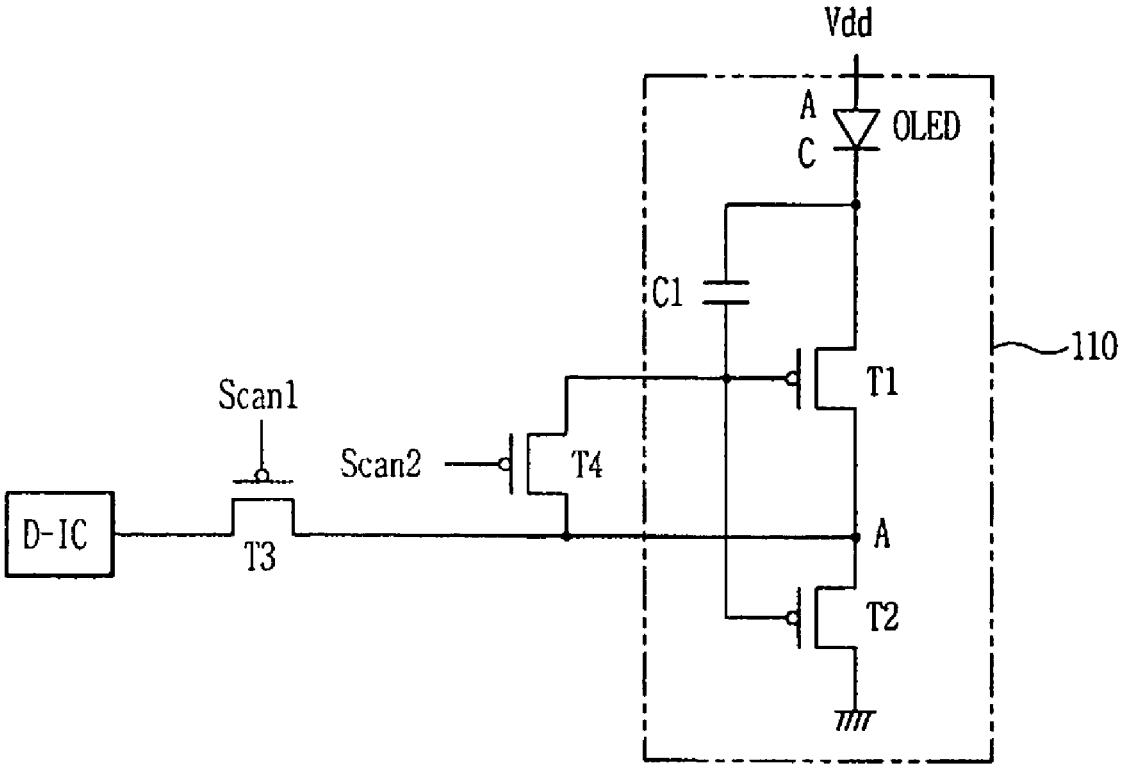
FIG. 1 is a circuit diagram illustrating a basic pixel structure of an organic electroluminescence display device according to an embodiment of the invention having a storage device.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

FIG. 1 is a circuit diagram illustrating a basic pixel structure of an organic electroluminescence display device according to an embodiment of the invention having a storage device. As shown in FIG. 1, the basic pixel structure of the organic electroluminescence display device includes a pixel circuit 110 and a data driver D-IC. The pixel circuit 110 includes an organic light emitting diode (OLED), a first transistor T1 and a second transistor T2 sequentially connected in series as driving devices between a power voltage Vdd and a ground, and a first capacitor C1 connected as a storage device between a gate and a source of the first transistor T1. The data driver D-IC determines a size of a voltage charged in the first capacitor C1 so as to determine a driving current $I_{EL}$ to be supplied to the OLED. A first switching device T3 and a second switching device T4 are connected between the data driver D-IC and the pixel circuit to control current flow between the data driver D-IC, and the first capacitor C1. The pixel circuit 110 also includes a top emission structure having an anode A of the OLED directly connected to the power voltage Vdd and a cathode C directly connected to the source of the first transistor T1. The data driver supplies a data current Id to the first capacitor C1 to create a voltage that will later control a driving current $I_{EL}$ from the power voltage Vdd through the OLED so as to control the luminance of the OLED.

Figure 2A:
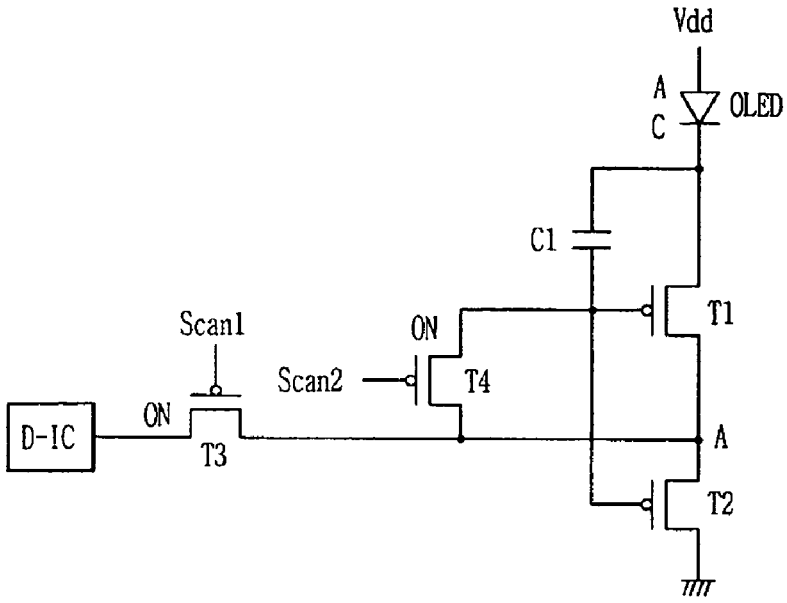
FIG. 2A to FIG. 2C illustrate the operation of a basic pixel in an organic electroluminescence display device according to an embodiment of the invention having a storage device.
Figure 2B:
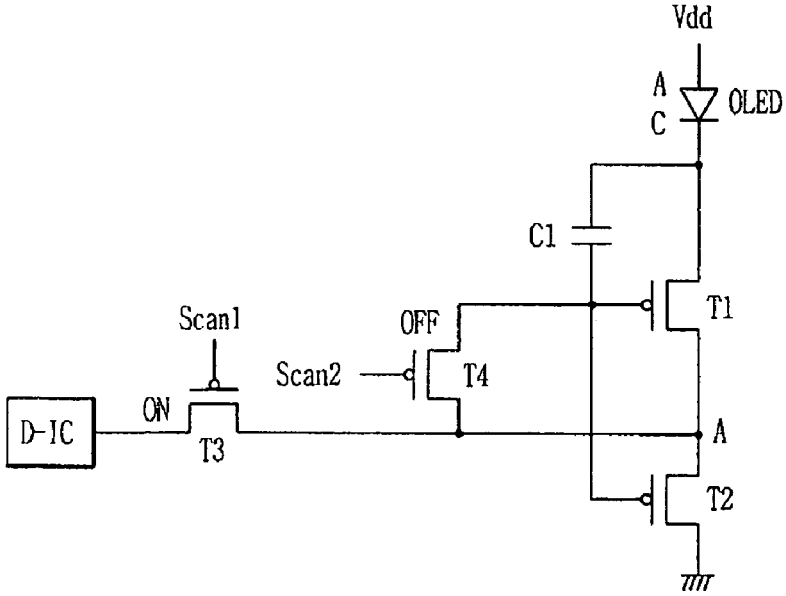
Figure 2C:
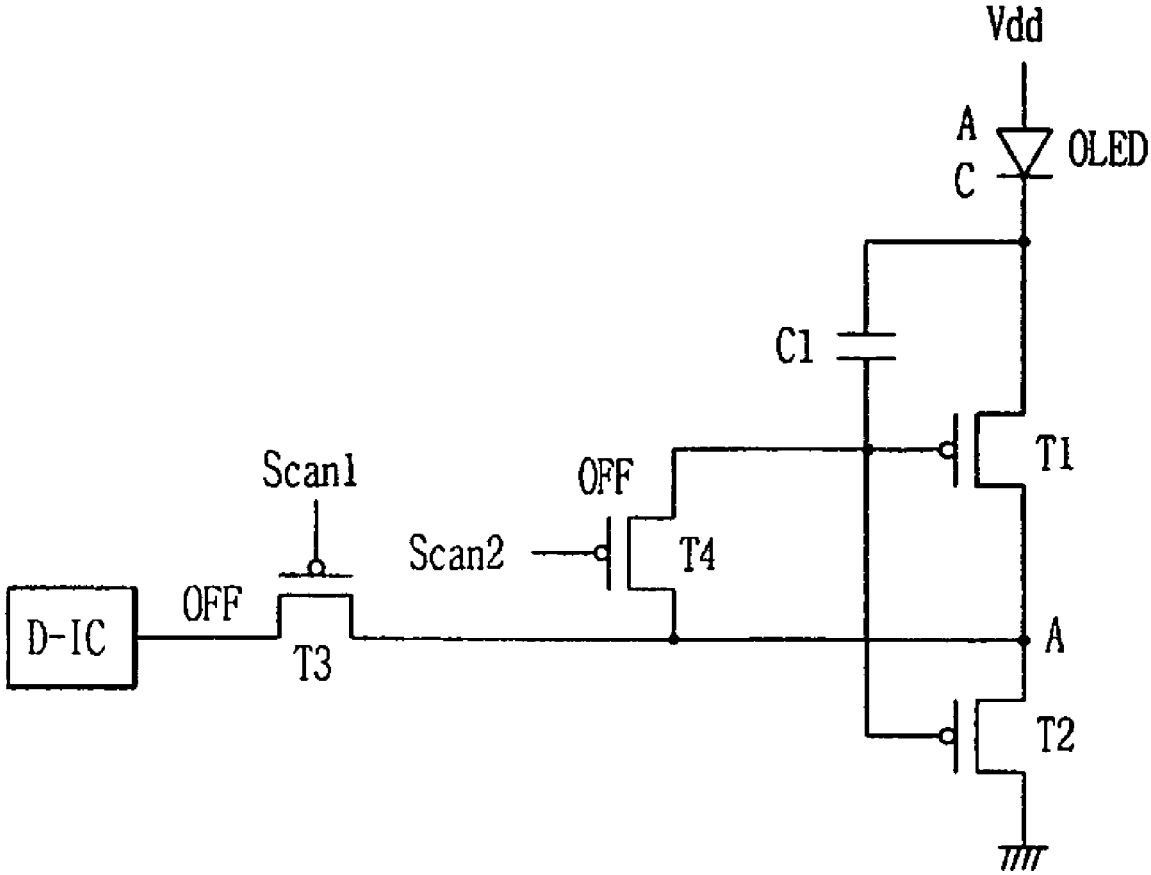

FIG. 2A to FIG. 2C illustrate the operation of the basic pixel in the organic electroluminescence display device according to an embodiment of the invention having a storage device. As shown in FIG. 2A, if the first switching device T3 and the second switching device T4 are respectively turned on as a first scan signal and a second scan signal become low voltages, a data current Id is supplied from the data driver D-IC through the first switching device T3. In the state in which the first and second switching devices T3 and T4 are turned on, a gate and a drain of the first transistor T1 have equivalent potential so that the first transistor T1 is operated in a saturation region. In other words, the first transistor T1 is turned on by a current through the first and second switching devices T3 and T4 so that the power voltage Vdd is electrically connected with the data driver D-IC. However, in the case of the second transistor T2 in which a gate and a source have equivalent potential, the second transistor T2 is turned off since the gate-source voltage Vgs becomes 0V.

The data driver D-IC controls a flow rate of a charging current that charges the first capacitor in accordance with the data current Id flowing in the first transistor T1. In other words, the size of the voltage that charges the first capacitor C1 is determined by the data current Id flowing in the first transistor T1. The data current Id is expressed by the following equation [1].

$$Id=k1(Vst-Vth)^2 \quad [1]$$

k1 denotes a current constant proportional to a W/L value of the first transistor T1, Vst denotes a driving voltage, and Vth denotes a threshold voltage. Thus, the data current Id value depends on the current constant of the first transistor T1.

To display images of various gray levels through pixels, luminance of the OLED is controlled to be at a variety of levels. To display various gray levels, the data driver D-IC controls the current supplied thereto, so that driving voltages of various sizes are charged into the first capacitor by the first transistor T1.

Next, as shown in FIG. 2B, as the first scan signal maintains a low voltage state and the second scan signal becomes a high voltage, the first switching device T3 is turned on while the second switching device T4 is turned off. In this case, the first capacitor C1 maintains the charged driving voltage, and the second transistor T2 maintains the turn-off state.

Subsequently, as shown in FIG. 2C, as the first scan signal becomes a high voltage in a state that the second signal becomes a high voltage, the second switching device T4 and the first switching device T3 are all turned off. At this time, the pixel circuit 110 is electrically disconnected from the data driver D-IC. The driving voltage stored in the first capacitor C1 is simultaneously applied to the gates of the first transistor T1 and the second transistor T2, so that the first transistor T1 and the second transistor T2 are all turned on.

In a state in which the first and second switching devices T3 and T4 are all turned off while the first capacitor C1 is charged to have a voltage, and since the OLED, the first transistor T1 and the second transistor T2 between the power voltage Vdd and the ground are electrically connected with one another, a driving current $I_{EL}$ flows in a node A. The driving current $I_{EL}$ is determined by current constants of the first and second transistors T1 and T2 connected in series as expressed by the following equation [2].

$$I_{EL}=(k1Sk2)/(k1+k2)S(Vst-Vth)^2=IdSk2/(k1+k2) \quad [2]$$

In the above equation, k2 is a current constant proportional to a W/L value of the second transistor T2. As can be derived from equations [1] and [2] above, the driving current $I_{EL}$/data current Id can be expressed as k2/(k1+k2). As shown in FIG. 2A to FIG. 2C, the first transistor T1 and the second transistor T2 operated like a diode when a gate is at the equivalent potential of either a source or a drain.

As described above, in basic circuit of the organic electroluminescence display device according to embodiments of the invention, the data current Id, which is greater than either the related art data current or the driving current $I_{EL}$ of the OLED, can be used to charge the first capacitor C1. In other words, since capacitance or storage of the data line can be charged at a current higher than that of the related art, high speed response can be obtained. However, considering an aperture ratio, a maximum W/L ratio between the first transistor T1 and the second transistor T2 is in the range of 1:4. In the pixel circuit of the basic circuit of the organic electroluminescence display device according to embodiments of the invention, a scaling factor between the driving current $I_{EL}$ and the data current Id is 1:5. However, it is difficult to efficiently control an OLED with a scaling factor of 1:5. Accordingly, a pixel circuit illustrating a basic pixel structure of an organic electroluminescence display device according to an embodiment of the invention having a storage device and a coupling unit will be described in detail with reference to FIG. 3 to FIG. 6, wherein the scaling factor between the driving current and the data current is increased.

Figure 3:
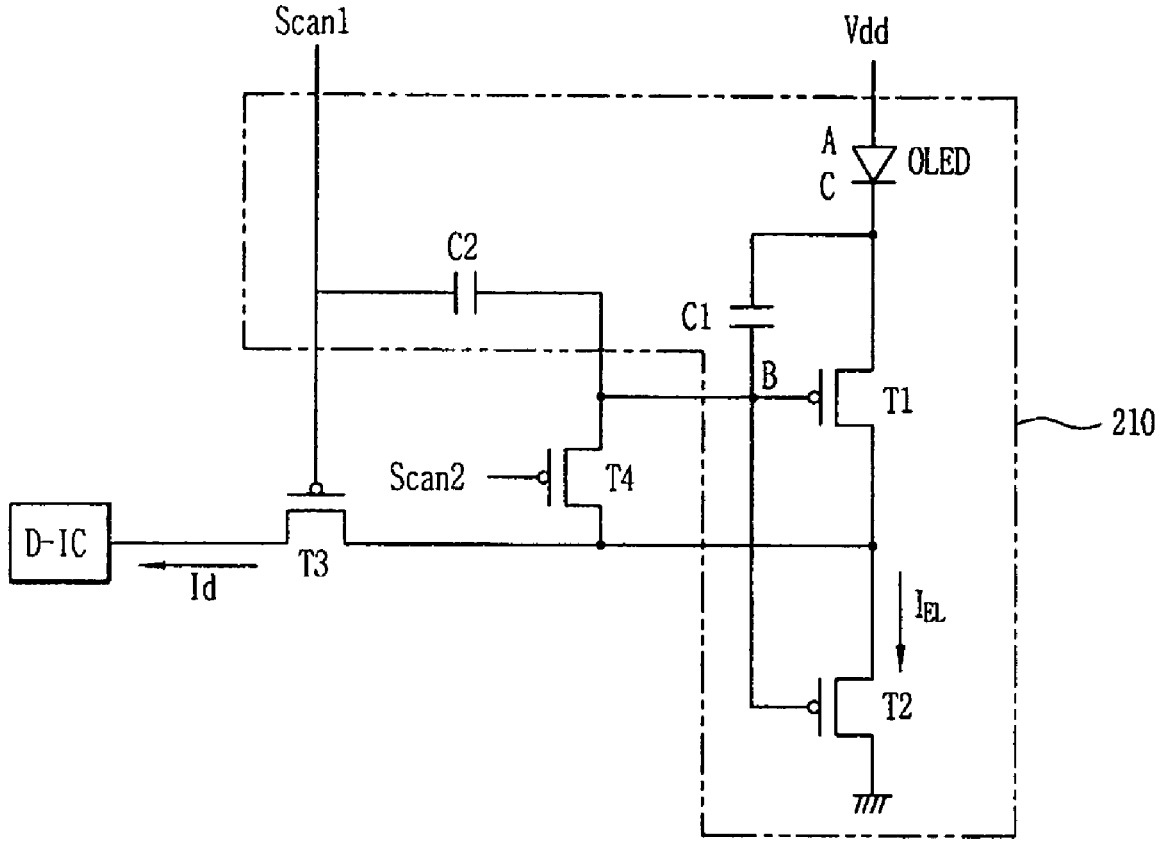
FIG. 3 is a circuit diagram illustrating a basic pixel structure of an organic electroluminescence display device according to an embodiment of the invention having a storage device.

FIG. 3 is a circuit diagram illustrating the basic pixel structure of the organic electroluminescence display device according to an embodiment of the invention having a storage device and a coupling unit. As shown in FIG. 3, the basic pixel structure of the organic electroluminescence display device according to another embodiment of the invention includes a pixel circuit 210 and a data driver D-IC. The pixel circuit 210 includes an OLED, a first transistor T1 and a second transistor T2 sequentially connected in series between a power voltage Vdd and a ground, a first capacitor C1 connected between a gate and a source of the first transistor T1, and a second capacitor C2 connected with the first capacitor C1. The data driver D-IC determines a size of a voltage charged in the first capacitor C1 so as to determine a current to be supplied to the OLED.

A first switching device T3 and a second switching device T4 are connected between the data driver D-IC and the pixel circuit 210 to control a current flow between the first and second transistors T1 and T2 and the data driver D-IC. In this case, one end of the second capacitor C2 is connected with the first capacitor C1, and its other end is applied with a first scan signal switching the first switching device T3.

The pixel circuit 210 also includes a top emission structure having an anode A of the OLED directly connected to the power voltage Vdd and a cathode C directly connected to the source of the first transistor T1. The data driver supplies a data current Id to the first capacitor C1 to create a voltage that will later control a driving current $I_{EL}$ from the power voltage Vdd through the OLED so as to control the luminance of the OLED.

Connection of the basic pixel structure of the organic electroluminescence display device according to an embodiment of the invention having a storage device and a coupling unit will be described in detail in reference to FIG. 3. The basic pixel includes a data driver D-IC supplying a data current Id according to a data signal, a first switching device T3 transferring the data current Id using a first scan signal scan1, a second switching device T4 transferring the data current from the first switching device T3 using a second scan signal scan2, a storage device C1 storing a voltage according to the data current transferred from the second switching device T4, a coupling unit C2 changing the voltage stored in the storage device C1 in accordance with the first scan signal, first and second driving devices T1 and T2 driven simultaneously in accordance with the voltage output from the coupling unit C2, and an OLED emitting light in accordance with the driving current $I_{EL}$ generated by driving of the first and second driving devices. The coupling unit C2 can be a capacitor. Also, the gates of the first and second driving devices T1 and T2 can be connected with each other. The first and second driving devices T1 and T2 can be P-type transistors connected in series between ground and the OLED.

One end of the first switching device T3 is supplied with the data current from the data driver D-IC, and its other end is connected with one end of the second switching device T4. The other end of the second switching device T4 is connected with one end of the coupling unit C2. Also, one end of the coupling unit C2 is connected with one end of the storage device C1. The other end of the coupling unit C2 is applied with the first scan signal scan1, and the other end of the storage device is supplied with the power voltage Vdd. Further, one end of the first driving device is supplied with the power voltage Vdd.

The second switching device T4, which transfers the data current transferred from the first switching device T3, is turned on by the second scan signal. In other words, the second scan signal is input to the gate of the second switching device T4. Although the first scan signal and the second scan signal may be input simultaneously, the second scan signal should be input within an input time period of the first scan signal.

Figure 4:
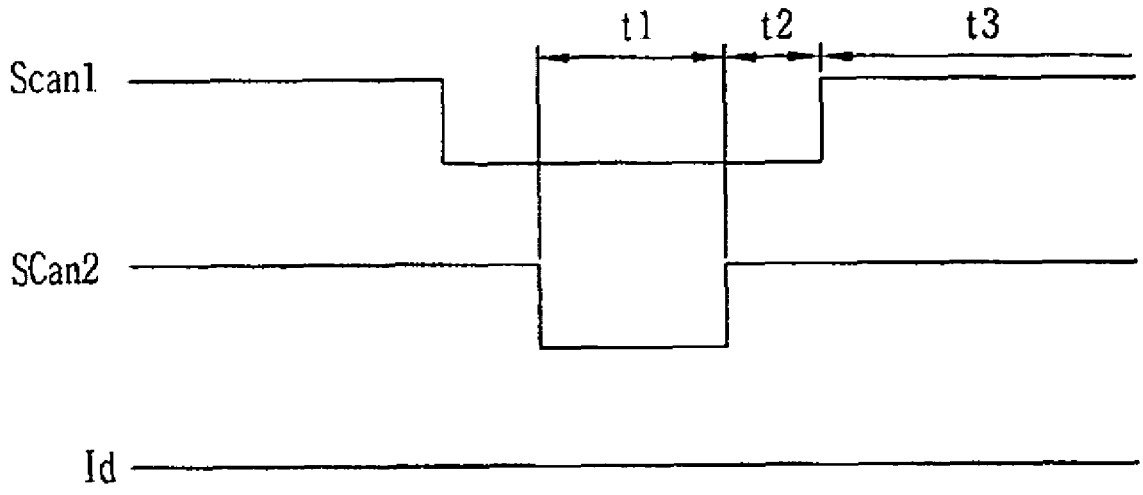
FIG. 4 is a flow chart illustrating a signal input to a basic pixel of an organic electroluminescence display device according to an embodiment of the invention having a storage device and a coupling unit.

The operation of the basic pixel of the organic electroluminescence display device according to another embodiment of the invention will be described in detail with reference to FIG. 4 and FIG. 5. FIG. 4 is a flow chart illustrating a signal input to the basic pixel of the organic electroluminescence display device according to an embodiment of the invention having a storage device and a coupling unit, and FIG. 5A to FIG. 5C illustrate the operation of the basic pixel in the organic electroluminescence display device according to an embodiment of the invention having a storage device and a coupling unit. In this embodiment, the second scan signal is turned-on within an input time period of the first scan signal, and the data current Id has a constant value.

Figure 5A:
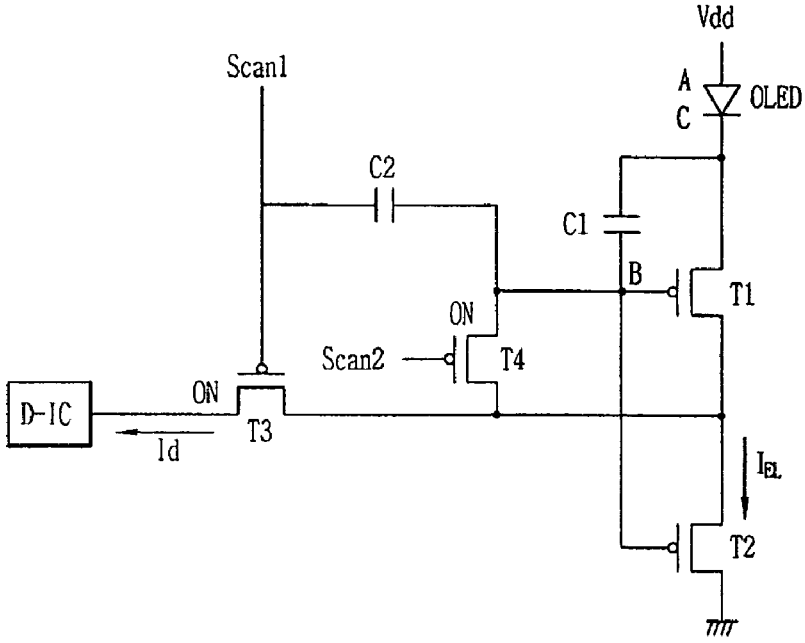
FIG. 5A to FIG. 5C illustrate the operation of a basic pixel in an organic electroluminescence display device according to an embodiment of the invention having a storage device and a coupling unit.

As shown in FIG. 4 and FIG. 5A, if the first switching device T3 and the second switching device T4 are respectively turned on as the first scan signal scan1 and the second scan signal scan2 become low voltages in a time period t1, a data current Id is supplied from the power voltage Vdd to the data driver D-IC through the first transistor T1. At this time, supposing that the voltage stored in the storage device C1 is Vc1, the relation between the data current Id and Vc1 is expressed by the following equation [3].

$$Id=\tfrac{1}{2}SpSk3(Vc1-Vdd-Vth)^2 \quad [3]$$

Accordingly, the voltage Vc1 can by the following equation [4].

$$Vc1=Vdd+Vth-(2Id/\mu k3)^{1/2} \quad [4]$$

Figure 5B:
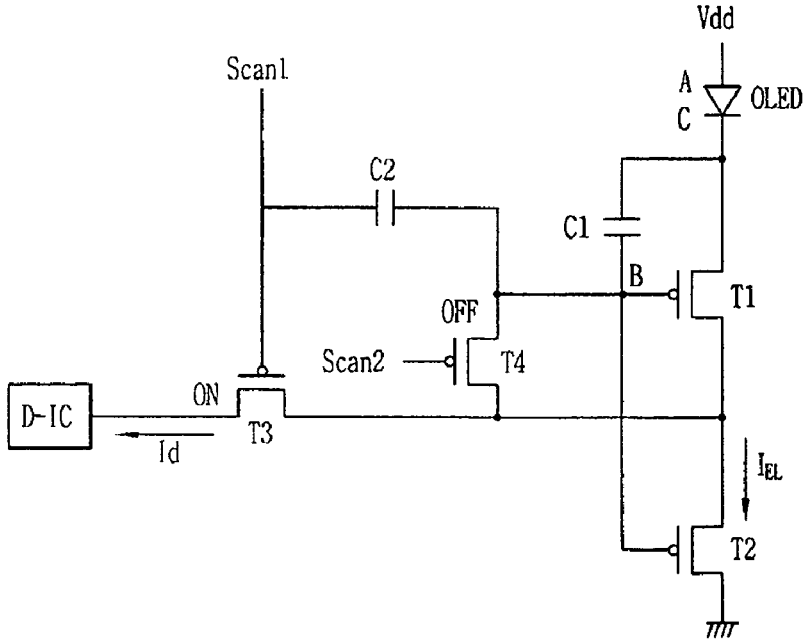
Figure 5C:
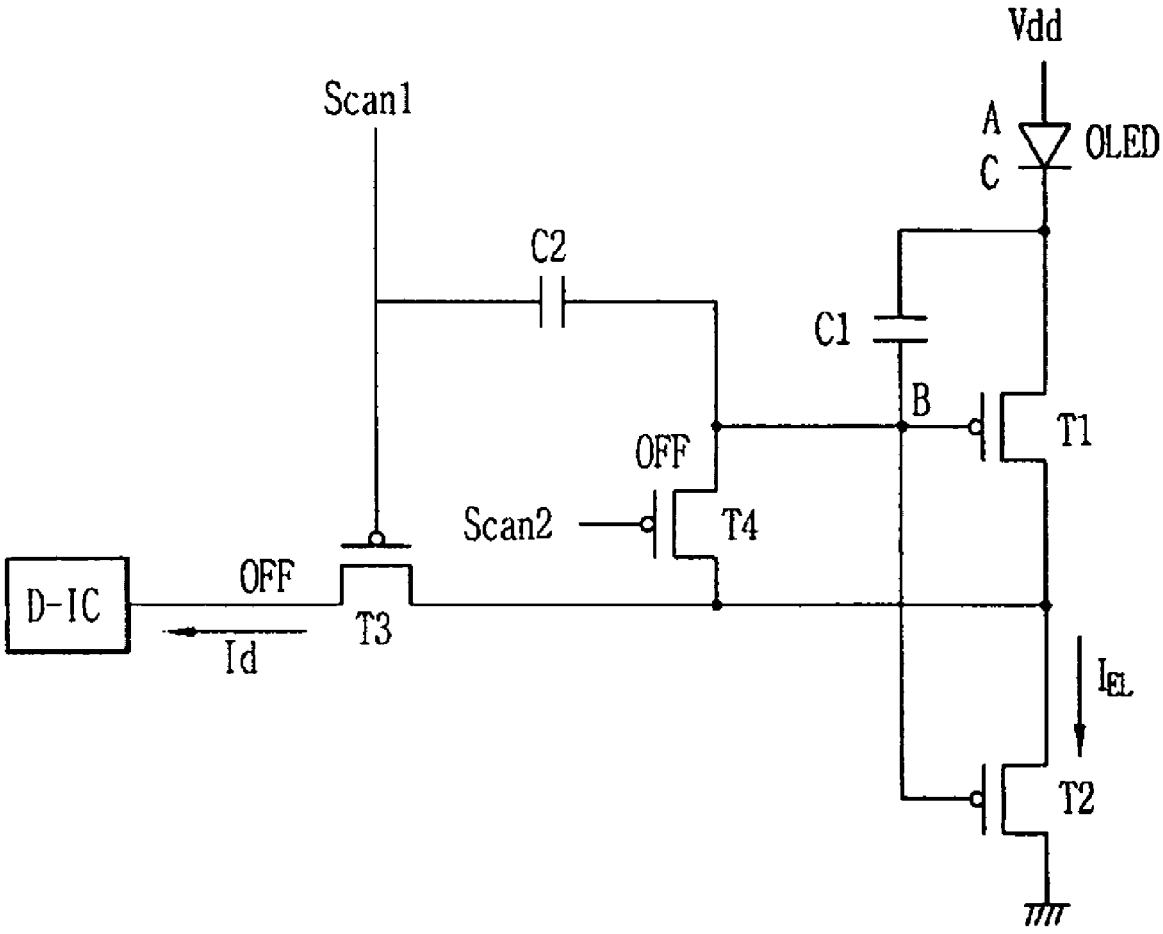

As shown in FIG. 4 and FIG. 5B, as the first scan signal scan1 maintains the low voltage state and the second scan signal scan2 becomes a high voltage in a time period t2, the first switching device T3 is turned on while the second switching device T4 is turned off. In this case, the first capacitor C1 maintains the charged driving voltage as it is and the second transistor T2 also maintains the turn-off state.

Next, as shown in FIG. 4 and FIG. 5*a*, when the first scan signal is changed from the low voltage to the high voltage in a time period t3, a voltage Vb of a node B is changed by a coupling effect of the coupling unit C2 connected with the first scan signal. At this time, the voltage Vb of the node B by the following equation [5].

$$Vb=Vc1+\Delta V\text{scan}1SC2/(C1+C2) \quad [5]$$

In the above equation, Δ vscan1 is a voltage change width of the first scan signal, i.e., a change width from the low voltage to the high voltage.

As described above, since the voltage Vb of the node B can be reduced to a ratio in size between the storage device C1 and the coupling unit C2, the driving current driving the OLED can be reduced greatly in comparison with the data current. Also, since the sum in size of both the storage device C1 and the coupling unit C2 can be equal to the size of the storage device C1 of the aforementioned embodiment, aperture ratio is not reduced.

Although the first scan signal and the second scan signal simultaneously increase from the low voltage to the high voltage, since the voltage Vb of the node B may be affected by the data current Id, the first switching device T1 can be turned off after the second switching device T4 is completely turned off. In other words, after the second scan signal is increased to the high voltage, the first scan signal is increased to the high voltage.

Figure 6A:
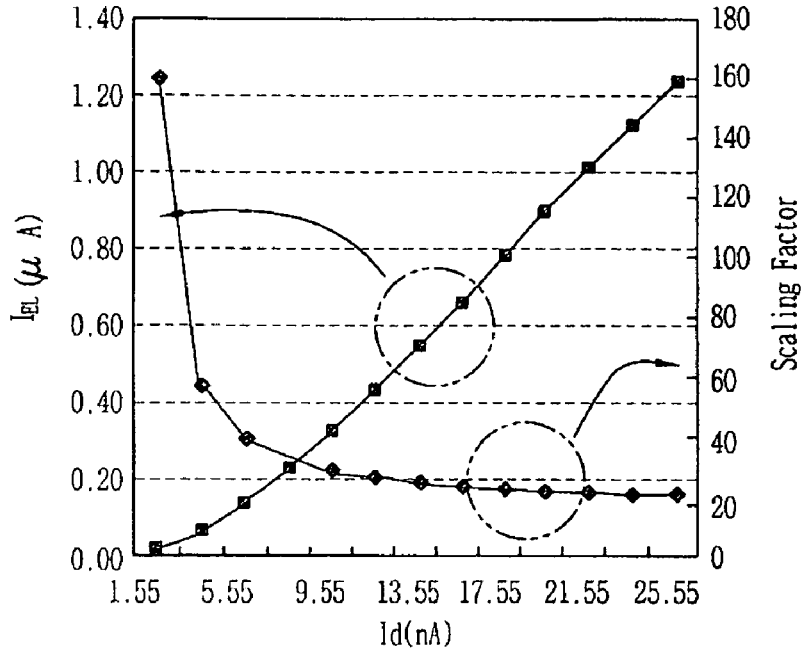
Figure 6B:
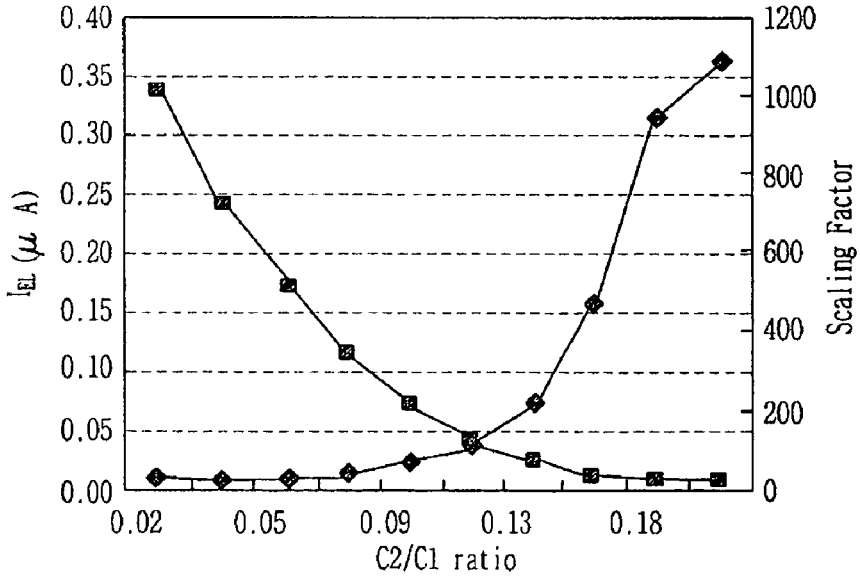
Figure 6C:
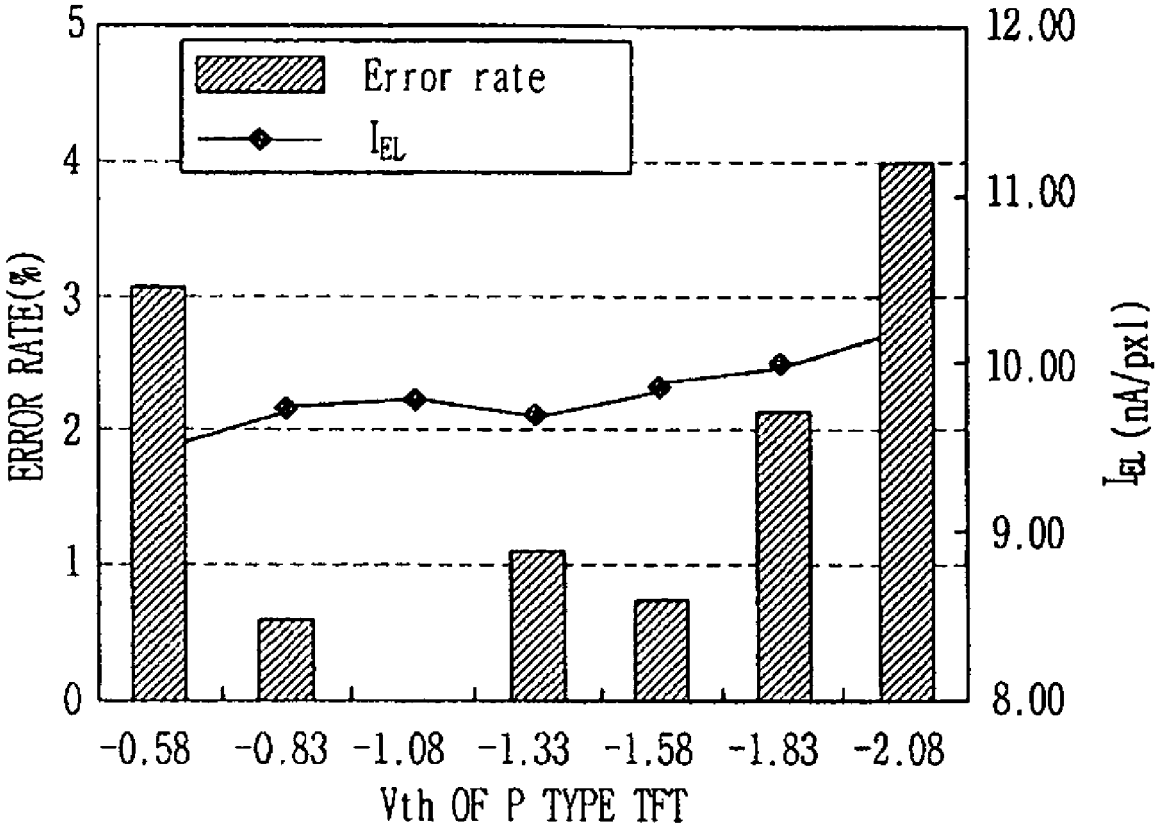

FIG. 6A to FIG. 6C illustrate simulation results of the basic pixel according to an embodiment of the invention having a storage device and a coupling unit, in which FIG. 6A is a graph illustrating the relation between the data current Id and the driving current $I_{EL}$ flowing in the OLED, FIG. 6B is a graph illustrating the scaling factor of the data and driving currents according to C2/C1, and FIG. 6*c* is a graph illustrating variation of the driving current $I_{EL}$ according to variation of a threshold voltage. The scaling factor denotes the ratio of data current Id/driving current $I_{EL}$.

As shown in FIG. 6A, the data current Id and the driving current $I_{EL}$ has a large scaling factor. In this case, C2/C1 is 20 fF/280 fF. Thus, when the data current Id is about 1.55 uA, the driving current $I_{EL}$ is 10 nA so as to have a scaling factor of about 115:1.

As shown in FIG. 6B, when C2 is changed to 5~50 fF under the condition that the data current Id is 5 uA and C1+C2=300 fF is made, a high coupling effect occurs as C2 increases. As a result, the change width of the voltage Vb at the node B increases, and thus the scaling factor increases to 1000:1.

As shown in FIG. 6C, when C2/C1 is 20 fF/280 fF, the data current Id is about 1.55 uA, the driving current $I_{EL}$ is 10 nA, and the threshold voltage Vth is changed to −0.55 to −2.08, an error of the driving current is less than 4% over the whole area. As a result, this embodiment of the invention can be stably driven.

As described above, according to embodiments of the invention, the organic electroluminescence display device can be driven at a low driving current in the current driving mode even though a high data current is applied thereto. Also, since the size of the area used for capacitors in the organic electroluminescence display device can be maintained, the data current can be reduced by 1/150 of the driving current. In other words, the organic electroluminescence display element can be driven at the low driving current through the high data current without a decrease in aperture ratio. Since the error rate of the driving current is low, the organic electroluminescence display device can stably be driven even in case that the threshold voltage is changed in a great width.

It will be apparent to those skilled in the art that various modifications and variations can be made in the an organic electroluminescence display device of embodiments of the invention without departing from the spirit or scope of the invention. Thus, it is intended that embodiments of the invention cover the modifications and variations of this invention provided they come within the scope of the appended claims and their equivalents.

What is claimed is:

1. An electroluminescence display device comprising:

a data driver for supplying a data current according to a data signal;

a first switching device for transferring a data current using a first scan signal;

a second switching device for transferring the data current from the first switching device using a second scan signal;

a storage device for storing a charge voltage according to the data current transferred from the second switching device;

a coupling unit for changing the charge voltage stored in the storage device in accordance with the first scan signal into a changed voltage;

a first driving device and a second driving device for generating a driving current in accordance with the changed voltage; and an organic light emitting diode for emitting light in accordance with the driving current, wherein the first switching device has one end supplied with the data current and the other end connected with one end of the second switching device, the second switching device has the other end connected with one end of the coupling unit, the storage device has one end to which a power voltage is connected, the coupling unit has one end connected with the other end of the storage device and the other end to which the first scan signal is input, and gates of the first driving device and the second driving device is connected with each other.

2. The electroluminescence display device as claimed in claim 1, wherein the two transistors include P-type transistors.

3. The electroluminescence display device as claimed in claim 1, wherein the first and second switching devices include P-type transistors.

4. The electroluminescence display device as claimed in claim 1, wherein the one end of the coupling unit is connected with one end of the storage device.

5. The electroluminescence display device as claimed in claim 4, wherein the voltage supplied from an other end of the storage device drives the first driving device and the second driving device.

6. The electroluminescence display device as claimed in claim 5, wherein the first driving device has one end connected with the organic light emitting diode and the other end connected with one end of the second driving device, wherein the second driving device has the other end connected with ground.

7. A method of operating electroluminescence display, comprising applying a first scan signal having a low voltage state to a first switching device for transferring a data current;

applying a second scan signal having the low voltage state to a second switching device for transferring the data current from the first switching;

charging a storage device with a charge voltage according to the data current transferred from the second switching device;

changing the low voltage state of the second scan signal into a high voltage state;

changing the low voltage state of the first scan signal into a high voltage state for changing the charge voltage stored in the storage device with a coupling unit in accordance with the first scan signal into a changed voltage;

applying the changed voltage simultaneously to the first and second driving devices; and driving an organic light emitting diode for emitting light in accordance with a driving current through the first and second driving devices, wherein the second scan signal is input within an input time period of the first scan signal.

* * * * *